US009646797B2

(12) United States Patent
Einat

(10) Patent No.: US 9,646,797 B2
(45) Date of Patent: May 9, 2017

(54) FERROELECTRIC EMITTER FOR ELECTRON BEAM EMISSION AND RADIATION GENERATION

(71) Applicant: ARIEL—UNIVERSITY RESEARCH AND DEVELOPMENT COMPANY, LTD., Ariel (IL)

(72) Inventor: Moshe Einat, Ariel (IL)

(73) Assignee: Ariel-University Research and Development Company Ltd., Ariel (IL)

( * ) Notice: Subject to any disclaimer, the term of this patent is extended or adjusted under 35 U.S.C. 154(b) by 0 days.

(21) Appl. No.: 14/903,602

(22) PCT Filed: Aug. 11, 2014

(86) PCT No.: PCT/IB2014/063847
§ 371 (c)(1),
(2) Date: Jan. 8, 2016

(87) PCT Pub. No.: WO2015/022621
PCT Pub. Date: Feb. 19, 2015

(65) Prior Publication Data

US 2016/0148773 A1 May 26, 2016

(30) Foreign Application Priority Data

Aug. 11, 2013 (IL) ..... 227911

(51) Int. Cl.
*H01J 1/30* (2006.01)
*H01J 29/04* (2006.01)
*H01J 23/06* (2006.01)
*H01J 25/02* (2006.01)

(52) U.S. Cl.
CPC ..... *H01J 1/30* (2013.01); *H01J 23/06* (2013.01); *H01J 25/025* (2013.01); *H01J 29/04* (2013.01); *H01J 2201/306* (2013.01)

(58) Field of Classification Search
None
See application file for complete search history.

(56) References Cited

U.S. PATENT DOCUMENTS 5,453,661 A 9/1995 Auciello et al.
5,874,802 A 2/1999 Choi et al.
2008/0231164 A1* 9/2008 Kim ..... H01J 11/40 313/491

(Continued)

OTHER PUBLICATIONS

G. Rosenman, D. Shur, Y. Krasik and A. Dunaevsky, "Electron emission from ferroelectrics," Journal of Applied Physics, vol. 88, No. 11, pp. 6109,6161, Dec. 2000.

(Continued)

*Primary Examiner* — Ashok Patel
(74) *Attorney, Agent, or Firm* — Greenberg Traurig, LLP

(57) ABSTRACT

Disclosed are methods and devices suitable for generating electron beams and pulses of radiation. Specifically, in some disclosed embodiments, multiple emitting electrodes of a ferroelectric emitter are sequentially activated, generating a relatively long electron beam pulse that is substantially a series of substantially consecutive short electron beam pulses generated by the sequentially-activated individual emitting electrodes.

29 Claims, 5 Drawing Sheets

(56) References Cited

U.S. PATENT DOCUMENTS

2010/0094266 A1* 4/2010 Travish ..... H01J 35/14 606/15
2014/0203707 A1* 7/2014 King ..... H01J 9/02 315/111.81

OTHER PUBLICATIONS

M. Einat, E. Jerby and G. Rosenman, "Spectral measurements of gyrotron oscillator with ferroelectric electron gun," Applied Physics Letters, vol. 81, No. 7, pp. 1347-1349, Aug. 2002.
M. Einat, E. Jerby and G. Rosenman, "High-repetition-rate ferroelectric-cathode gyrotron," Applied Physics Letters, vol. 79, No. 25, pp. 4097-4099, Dec. 2001.
M. Einat, E. Jerby and G. Rosenman, "A ferroelectric electron gun in a free-electron maser experiment," Nuclear Instruments & Methods in Physics Research, Section A (Accelerators, Spectrometers, Detectors and Associated Equipment), vol. 483, No. 1-2, pp. 326-330, May 2002.
Y. Hayashi, X. Song, J. D. Ivers, D. Flechtner, J. A. Nation and L. Schacter, "High-power microwave generation using a ferroelectric cathode electron gun," Plasma Science, IEEE Transactions on, vol. 29, No. 4, pp. 599,603, Aug. 2001.
M. Einat, E. Jerby and G. Rosenman, "Free-electron maser driven by a two-stage ferroelectric electron gun," Journal of Applied Physics, vol. 93, No. 4, pp. 2304,2306, Feb. 2003.
M. Einat, E. Jerby and G. Rosenman, "A microwave gyro amplifier with a ferroelectric cathode," Microwave Theory and Techniques, IEEE Transactions on, vol. 50, No. 4, pp. 1227-1230, Apr. 2002.
Y. Hadas, A. Sayapin, T. Kweller and Y. Krasik, "S-band relativistic magnetron operation with an active plasma cathode," Journal of Applied Physics, vol. 105, No. 8, pp. 083307,083307, Apr. 2009.
M. Einat, M. Pilossof, R. Ben-Moshe, H. Hirshbein and D. Borodin, "95 GHz Gyrotron with Ferroelectric Cathode," Physical Review Letters, vol. 109, No. 18, p. 185101 (5 pp.), Nov. 2012.
V. Engelko, "Formation of stable longpulse electron beams with the help of explosive emission cathodes," Plasma Devices and Operations, vol. 13, No. 2, pp. 135-142, Jun. 2005.
M. Einat, D. Shur, E. Jerby and G. Rosenman, "Lifetime of ferroelectric Pb(Zr, Ti)O3 ceramic cathodes with high current density," Journal of Applied Physics, vol. 89, No. 1, pp. 548,552, Jan. 2001.
A. Dunaevsky, Y. Krasik, J. Felsteiner, S. Dorfman, A. Berner and A. Sternlieb, "Lifetime of ferroelectric cathodes," Journal of Applied Physics, vol. 89, No. 8, pp. 4480,4485, Apr. 2001.
Pilossof et al., "Lifetime extension of ferroelectric cathodes for microwave tubes," Nuclear Instruments & Methods in Physics Research, Section A, vol. 636, No. 1, pp. 8-12, Apr. 2011.
R. Advani, J. -P. Hogge, K. Kreischer, W. Mulligan, R. Temkin, G. Kirkman, B. Jiang and N. Reinhardt, "Kiloampere and microsecond electron beams from ferroelectric cathodes," Plasma Science, IEEE Transactions on, vol. 26, No. 4, pp. 1347,1352, Aug. 1998.
J. Z. Gleizer, D. Yarmolich, V. Vekselman, J. Felsteiner and Y. E. Krasik, "High-current large-area uniform electron beam generation by a grid-controlled hollow anode with multiple-ferroelectric-plasma-source ignition," Plasma Devices and Operations, vol. 14, No. 3, pp. 223-235, Sep. 2006.
Yafit Orbach et. al. "Gyrotron With Dual Electrode Ferroelectric Cathode Operating at High Repetition Rate and Long Pulse," IEEE Transactions on Electron Devices, vol. 61, No. 3, Mar. 2014.
International Search Report and Written Opinion of International Application PCT/IB2014/063847, Mailed Sep. 28, 2014.

* cited by examiner

FERROELECTRIC EMITTER FOR ELECTRON BEAM EMISSION AND RADIATION GENERATION

RELATED APPLICATION

The present application gains priority from Israel Patent Application IL 227911 filed 11 Aug. 2013, which is included by reference as if fully set-forth herein.

FIELD AND BACKGROUND OF THE INVENTION

The invention, in some embodiments, relates to the field of electron beam emission and more particularly, but not exclusively, to ferroelectric emitters suitable for the emission of electron beams. The invention, in some embodiments, also relates to the field of millimeter waves, and more particularly, but not exclusively, to gyrotrons.

Ferroelectric (FE) emitters have been investigated as a cold electron source for many applications including electron guns. After long period of scientific discussion regarding the emission mechanism, several experimental devices were demonstrated, and it was proven that the FE emitter can be integrated into microwave tubes [refs. 2-7]. Recent achievements extend the use of such emitters to S-band relativistic magnetrons [ref. 8] and 95 GHz gyrotrons [ref. 9]. Depending on the implementation, FE emitters may have one or more advantages including: FE emitters are cold emitters, FE emitters can withstand relatively high currents, have a relatively short (immediate) turn on time, need no conditioning, require modest vacuum to operate, and are relatively inexpensive.

While thermionic emitters can emit long pulses and even continuous beams, plasma emitters such as FE emitters are limited to short-pulse operation [ref. 10]. Some of the factors which limit the duration of the pulses include the gap closure, and the plasma relaxation time that limits the pulse repetition frequency (PRF). The FE emission is a plasma-assisted effect. When an FE emitter is operated in an electron tube, surface plasma is ignited on a front electrode on the distal (front) side of the emitter and electrons are drawn towards the anode. Thus, an FE emitter is limited to short pulses (typically 100-300 ns). Pulse duration, PRF, and possible duty cycle of an electron tube are all determined by the emitter and limit the electron tube performance.

Emitter lifetime is another limiting factor for ferroelectric emitters. Although FE emitters have an infinite shelf lifetime and do not need refreshing when not operative, during emitter operation generated surface plasma tends to damage the emitter surface and gradually degrades emitter performance. Lifetimes of FE emitters have been studied [refs. 11-13] where the emitters were operated in different PRF's in the range of 1 Hz-1 kHz.

Research to prolong the pulse duration of electron beams generated in tubes having FE emitters has been done. Early attempts are reported in the work of Advani et al. [ref. 14] where a 5 microsecond single pulse is achieved from an 11.4 cm diameter annular ferroelectric emitter. This emitter was designed for a gyrotron but it was not implemented in an FE tube, and no radiation was obtained.

Prolonging of pulse duration in different plasma emitters, based on explosive emission, was reported by Engelko [refs. 10] where multipoint ignition was used to overcome the plasma limitation, generating a 30 microsecond current pulse length. This demonstration included an electron gun, but radiation from an electron tube was not reported. Engelko's method was later implemented by Gleizer et al. [ref. 15] with FE emitters, obtaining single pulses of ~6 microsecond, reporting an electron beam, but without generating radiation.

Radiation from an FE tube has been reported by Hadas et al. [ref. 8], where an S-Band magnetron with an FE emitter was compared to the same tube with an explosive emission emitter. The use of the ferroelectric emitter extended the duration of the radiated pulse by ~30% to 100 ns, and increased the microwave radiation power by ~10%. It is clearly determined in the experiment that the FE emitter is ~30% more efficient than an explosive emission emitter in the tested tube. In other studies demonstrating the integration of ferroelectric emitter in electron tubes in a gyrotron [refs. 3, 4], a PRF of 3 MHz and duty cycle of up to 50% was measured with 150 ns pulses. However, FE emitter tubes with long pulses were not reported.

SUMMARY OF THE INVENTION

Some embodiments of the invention herein relate to methods for generating electron beams and ferroelectric emitters suitable for generating electron beams. In some embodiments, an FE emitter having at least two front electrodes is provided that allows the generation of an electron beam at high PRF and flexible duty cycle. In some embodiments, the duty cycle is tuned to 100% to obtain long pulse length electron beams.

According to an aspect of some embodiments of the invention, there is provided a method for generating an electron beam, the method comprising:

a) providing a ferroelectric emitter having at least two mutually-separated distal emitting electrodes inside a vacuum; and b) sequentially activating distal emitting electrodes thereby generating an electron beam pulse from the emitter that is a series of substantially consecutive short electron beam pulses generated by the sequentially-activated individual distal emitting electrodes.

According to an aspect of some embodiments of the invention, there is also provided a method of generating radiation, the method comprising generating an electron beam pulse according to the teachings herein and directing the generated electron beam to enter a magnetic field, thereby generating radiation.

According to an aspect of some embodiments of the invention, there is also provided a method of generating radiation, the method comprising generating an electron beam pulse according to the teachings herein, and directing the generated electron beam to drive a radiation-generating device, the radiation-generating device thereby generating radiation.

According to an aspect of some embodiments of the invention, there is also provided a ferroelectric emitter, comprising at least two mutually-separated distal emitting electrodes.

In some embodiments, the ferroelectric emitter comprises:

an emitter body of ferroelectric material having a proximal face and a distal face;

at least one proximal electrode contacting the proximal face of the emitter body; and the at least two mutually-separated distal emitting electrodes contacting the distal face of the emitter body.

In some embodiments, the ferroelectric emitter further comprises a triggering assembly, configured to sequentially activate the distal emitting electrodes. In some embodiments, the ferroelectric emitter further comprises a triggering assembly, that when operated sequentially activates the distal emitting electrodes.

According to an aspect of some embodiments of the invention, there is also provided an electron gun, comprising a vacuum tube, and functionally associated with the vacuum tube, a ferroelectric emitter according to the teachings herein.

According to an aspect of some embodiments of the invention, there is also provided a radiation-generating device, comprising a ferroelectric emitter and/or an electron gun according to the teachings herein.

Unless otherwise defined, all technical and scientific terms used herein have the same meaning as commonly understood by one of ordinary skill in the art to which the invention pertains. In case of conflict, the specification, including definitions, takes precedence.

As used herein, the terms "comprising", "including", "having" and grammatical variants thereof are to be taken as specifying the stated features, integers, steps or components but do not preclude the addition of one or more additional features, integers, steps, components or groups thereof.

As used herein, the indefinite articles "a" and "an" mean "at least one" or "one or more" unless the context clearly dictates otherwise.

As used herein, when a numerical value is preceded by the term "about", the term "about" is intended to indicate +/−10%.

BRIEF DESCRIPTION OF THE FIGURES

Some embodiments of the invention are described herein with reference to the accompanying figures. The description, together with the figures, makes apparent to a person having ordinary skill in the art how some embodiments of the invention may be practiced. The figures are for the purpose of illustrative discussion and no attempt is made to show structural details of an embodiment in more detail than is necessary for a fundamental understanding of the invention. For the sake of clarity, some objects depicted in the figures are not to scale.

In the Figures.

DESCRIPTION OF SOME EMBODIMENTS OF THE INVENTION

Figure 1:
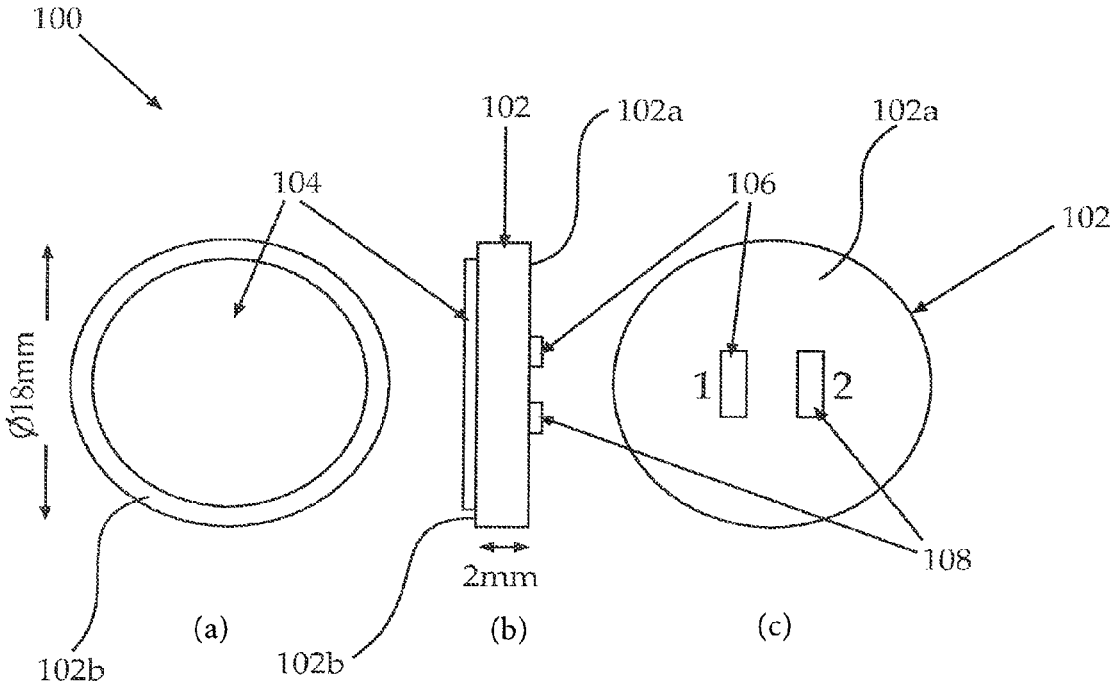
FIG. 1 is a schematic depiction of front, side, and rear views of a ferroelectric emitter, according to some embodiments of the teachings herein.

The invention, in some embodiments, relates to the field of electron beam emission and more particularly, but not exclusively, to ferroelectric emitters suitable for the emission of electron beams.

In some embodiments, the teachings herein provide methods and ferroelectric emitters suitable for producing a long current pulse and/or a long radiation pulse.

In some embodiments, the teachings herein provide methods and ferroelectric emitters suitable for producing a continuous current pulse and/or a continuous radiation pulse.

For example, in some embodiments, a ferroelectric emitter having two or more emitting electrodes is used to emit electrons based on plasma generation yet operates in a long pulse, and serves as an electron source for a millimeter-wave tube. As used herein, the terms "front electrode", "emitting electrode", "distal electrode" and "distal emitting electrode" are synonyms.

According to an aspect of some embodiments of the invention, there is provided a method for generating an electron beam, comprising:

a) providing a ferroelectric emitter having at least two mutually-separated distal emitting electrodes inside a vacuum; and b) sequentially activating the distal emitting electrodes thereby generating an electron beam pulse from the emitter that is a series of substantially consecutive short electron beam pulses generated by the sequentially-activated individual distal emitting electrodes.

In some embodiments, all of the short electron beam pulses are substantially identical (e.g., in terms of duration and/or intensity). In some embodiments, some of the short electron beam pulses are different from others, for example are of greater intensity and/or different duration.

In some embodiments, sequential activation comprises only one distal emitting electrode operating to generate a short electron beam pulse at any one moment. In some embodiments, during the sequential activation more than one of the distal emitting electrode is operating concurrently to generate a short electron beam pulse at any one moment, but have a different start time and/or ending time of activation. In some embodiments, sequential activation comprises at least two distal emitting electrode operating substantially with the same starting time, same ending time and same duration, and there is at least a third distal emitting electrode that is operated sequentially with a different starting time and/or ending time.

As used herein, by "short electron beam pulse" is meant that the electron beam pulse produced by a single emitting electrode has a shorter duration than the electron beam pulse that is made up of the series of such short electron beam pulses.

According to an aspect of some embodiments of the invention, there is provided a ferroelectric emitter, comprising at least two mutually-separated distal emitting electrodes. In some embodiments, there is provided a ferroelectric emitter comprising:

an emitter body of ferroelectric material having a proximal face and a distal face;

at least one proximal (back) electrode contacting the proximal face of the emitter body; and at least two mutually-separated (having no direct electric contact between them, that is to say electrically insulated one from the other) distal (front) emitting electrodes contacting the distal face of the emitter body.

In some embodiments, the ferroelectric emitter further comprises a triggering assembly configured to sequentially activate the distal emitting electrodes. In some embodiments, the ferroelectric emitter further comprises a triggering assembly, that when operated sequentially activates the distal emitting electrodes. Activating a distal emitting electrode comprises allowing electrical current to pass through the distal emitting electrodes that leads to generation of plasma by the distal emitting electrode.

Typically, the distal and proximal electrodes are of metal.

Each individual electrode is of any suitable shape, for example, squares, rectangles, triangles and curved shapes such as circles. Specifically, each individual electrode is of any suitable shape, for example, having a cross section in the plane of the emitter body that is a square, a rectangle, a triangle and a curved shape such as a circle. Some electrode shapes have one or more advantages when used in a specific embodiment. The arrangement of the individual electrodes one relative to the other is any suitable relative arrangement.

In some embodiments, there is provided an electron gun, comprising a vacuum tube, and functionally associated with the vacuum tube, a ferroelectric emitter as described herein.

When the ferroelectric emitter or electron gun is used in a radiation-generating device, such as a gyrotron tube, the distal emitting electrodes are sequentially activated by respective triggers. The sequential activation of multiple distal emitting electrodes enables the generation of a relatively long electron beam pulse from the emitter, relatively long electron beam being substantially a series of substantially consecutive short electron beam pulses. The short electron beam pulses are generated by the sequentially-activated individual distal emitting electrodes. In some embodiments, the relatively long electron beam pulse is used to generate a relatively long radiation pulse.

The principles, uses and implementations of the teachings of the invention may be better understood with reference to the accompanying description and figures. Upon perusal of the description and figures present herein, one skilled in the art is able to implement the teachings of the invention without undue effort or experimentation. In the figures, like reference numerals refer to like parts throughout.

Before explaining at least one embodiment of the invention in detail, it is to be understood that the invention is not necessarily limited in its application to the details of construction and the arrangement of the components and/or methods set forth herein. The invention is capable of other embodiments or of being practiced or carried out in various ways. The phraseology and terminology employed herein are for descriptive purpose and should not be regarded as limiting.

Method for Generating an Electron Beam

According to an aspect of some embodiments of the teachings herein, there is provided a method for generating an electron beam, the method comprising:

a) providing a ferroelectric emitter having at least two mutually-separated distal emitting electrodes inside a vacuum; and b) sequentially activating the distal emitting electrodes thereby generating a electron beam pulse from the emitter that is a series of substantially consecutive short electron beam pulses generated by the sequentially-activated individual distal emitting electrodes. The generated electron beam pulse that is a series of substantially consecutive short electron beam pulses is relatively long in comparison to the constituent short electron beam pulses.

In some embodiments, the sequential activation of the emitting electrodes is such that the duty cycle of the ferroelectric emitter is not less than 10%, not less than 14%, not less than 20%, not less than 30%, not less than 40%, not less than 50%, not less than 54%, not less than 60%, not less than 70%, not less than 80%, not less than 90% and even not less than 100%.

In some embodiments, the method further comprises: during the sequential activating, varying a duty cycle of the ferroelectric emitter. In some embodiments, the varying a duty cycle of the ferroelectric emitter comprises changing at least one variable selected from the group of variables consisting of:

a pulse width of at least one emitting electrode;

an inter-pulse interval of at least one emitting electrode;

a pulse-repetition frequency of at least one emitting electrode; and a duty cycle of at least one emitting electrode.

Pulse Width

In some embodiments, during the sequential activation, an emitting electrode is activated (triggered) to produce plasma for a period of time, the duration of which is a pulse width. Any suitable pulse width may be used in implementing the teachings herein. Typically, the maximal pulse width is determined to avoid "gap closure", that is to say, a situation where the electron pulse is sufficiently long so as to cause a short circuit between the emitting electrode and an anode. The minimal pulse width is any minimal pulse width and is limited by the triggering mechanism (e.g., triggering assembly) associated with the emitting electrode. In the laboratory, the Inventor has demonstrated, inter alia, pulses as short as 40 nanoseconds and as long as 2100 nanoseconds. In some embodiments, the pulse width is not less than 10 nanoseconds and even not less than 20 nanoseconds. In some embodiments, the pulse width is not more than 3000 nanoseconds, not more than 2900 nanoseconds, and even not more than 2800 nanoseconds.

Inter Pulse Interval

The inter-pulse interval of an emitting electrode is the time difference between the starting time of a pulse from one of the emitting electrodes and the starting time of a succeeding pulse from that emitting electrode and is any suitable time difference. In some embodiments, the difference is not more than 3.5 microseconds, not more than 2.0 microseconds, not more than 1.5 microseconds, not more than 1.0 microseconds and even not more than 0.5 microseconds. In some embodiments, the inter-pulse interval is the time required to avoid gap closure, which, depending on the embodiment, may be close to 0.1 microseconds.

Pulse Repetition Frequency

The pulse-repetition frequency of a given emitting electrode is any suitable pulse repetition frequency. In the laboratory, the Inventor has demonstrated pulses as short as 40 nanoseconds and as long as 2100 nanoseconds. In the laboratory, the Inventor has demonstrated, inter alia, emitting electrode pulse-repetition frequencies of 1.8 MHz. In some embodiments, the emitting electrode pulse repetition frequency is not faster than 5 MHz and even not faster than 2.5 MHz.

Emitting Electrode Duty Cycle

The duty cycle of each emitting electrode is any suitable duty cycle and is determined by factors such as the maximal pulse width, the number of emitting electrodes in the ferroelectric emitter, the triggering mechanism, the desired extent of concurrent activation of two different emitting electrodes (if at all), the desired difference in time between the end of a pulse from a first emitting electrode and the beginning of a pulse from a following emitting electrode and the desired characteristics (e.g., time-varying intensity) of the relatively long electron beam pulse resulting from the series of short electron beam pulses. In some embodiments, the emitting electrode duty cycle is up to 50%.

In some embodiments, the sequential activation of the distal emitting electrodes comprises:

from a first of the emitting electrodes, generating a beam of electrons for a first electrode period of time having a first electrode starting time, a first electrode duration, and a first electrode ending time; and subsequent to the first starting time, from a second of the emitting electrodes different from the first emitting electrode, generating a beam of electrons for a second electrode period of time having a second electrode starting time, a second electrode duration, and a second electrode ending time, wherein the second ending time is subsequent to the first ending time. In such embodiments (having any number of emitting electrodes), there is an "overlap of activation", a certain period of time between the second starting time and the first ending time where at least two emitting electrodes are simultaneously activated to both generate a beam of electrons.

In some embodiments, the sequential activation of the distal emitting electrodes comprises:

c) from a first of the emitting electrodes, generating a beam of electrons for a first period of time having a first starting time, a first duration, and a first ending time; and d) subsequent to the first ending time, from a second of the emitting electrodes different from the first emitting electrode, generating a beam of electrons for a second period of time having a second starting time, a second duration, and a second ending time. In some such embodiments having any number of emitting electrodes, there is no time when any two emitting electrodes are simultaneously activated to generate a beam of electrons: a single emitting electrode is activated at any one time. In some other such embodiments having any number of emitting electrodes, some electrodes are simultaneously activated (e.g., as a group having the same first starting time, first duration and first ending time) to generate a beam of electrons and subsequent to the first ending time, other electrodes are simultaneously activated (e.g., as a group having the same second starting time, second duration and second ending time).

In some embodiments, generating a beam of electrons from an emitting electrode (e.g., the first and/or second emitting electrode) comprises:

generating a plasma with an emitting electrode;

extracting electrons from the plasma; and forming an electron beam from the extracted electrons.

In some embodiments, the method further comprises accelerating the electrons forming the electron beam, for example, by applying a potential difference between an emitting electrode and an anode of an electron gun.

In some embodiments, the at least two mutually-separated distal emitting electrodes are selected from the group consisting of at least three, at least four, at least five, at least six, at least 20 and at least 10000 distal emitting electrodes.

Method of Generating Radiation

According to an aspect of some embodiments of the teachings herein, there is provided a method of generating radiation, the method comprising:

generating an electron beam pulse according to the teachings herein; and directing the generated electron beam (pulse) to enter a magnetic field, thereby generating radiation.

According to an aspect of some embodiments of the teachings herein, there is provided a method of generating radiation, the method comprising:

generating an electron beam pulse according to the teachings herein; and directing the generated electron beam (pulse) to drive a radiation-generating device, the radiation-generating device thereby generating radiation.

In some embodiments, the radiation-generating device is a gyrotron tube.

The teachings herein are suitable for the generation of radiation having any suitable frequency, for example, by changing the energy of the electrons of the electron beam that enter a magnetic field or that drive a radiation-generating device. That said, in some embodiments, the frequency of the generated radiation is between 1 and 300 GHz or between 2 GHz and 150 Ghz, for example 25 GHz.

The methods according to the teachings herein may be implemented using any suitable device. That said, in some embodiments it is advantageous to implement such methods using a device according to the teachings herein.

Ferroelectric Emitter

According to an aspect of some embodiments of the teachings herein, there is provided a ferroelectric emitter, comprising at least two mutually-separated distal emitting electrodes. In some embodiments, the emitting electrodes are coplanar. In some embodiments, the emitting electrodes are not coplanar.

In some embodiments the ferroelectric emitter, comprises:

an emitter body of ferroelectric material having a proximal face and a distal face;

at least one proximal electrode contacting the proximal face of the emitter body; and the at least two distal emitting electrodes contacting the distal face of the emitter body.

In some embodiments, the ferroelectric emitter further comprises a triggering assembly, configured to sequentially activate the distal emitting electrodes. In some embodiments, the ferroelectric emitter further comprises a triggering assembly, that when operated sequentially activates the distal emitting electrodes.

In some embodiments, the emitting electrodes and/or the triggering assembly are configured so that the ferroelectric emitter has a maximal duty cycle of not less than 10%, not less than 14%, not less than 20%, not less than 30%, not less than 40%, not less than 50%, not less than 54%, not less than 60%, not less than 70%, not less than 80%, not less than 90% and even not less than 100%.

In some embodiments, the emitting electrodes and/or the triggering assembly are configured so that the ferroelectric emitter has a variable, user-selectable duty cycle. In some embodiments, such a user-selectable duty cycle is variable between any two values from 0% to 100%. In some embodiments, such a user-selectable duty cycle is variable by changing a duty cycle of at least one emitting electrode, a pulse-repetition frequency of at least one emitting electrode, a pulse width of at least one emitting electrode, and a inter-pulse interval of at least one emitting electrode.

In some embodiments, any two neighboring emitting electrodes are separated by not less than 0.5 mm, not less than 0.8 mm, not less than 1 mm and even not less than 1.5 mm.

In some embodiments, any two neighboring emitting electrodes are separated by not more than 50 mm, not more than 40 mm, not more than 30 mm and even not more than 20 mm.

In some embodiments, the at least two emitting electrodes are selected from the group consisting of at least three, at least four, at least five, at least six, at least 20 emitting electrodes, and even at least 10000 emitting electrodes.

Electron Gun

According to an aspect of some embodiments of the teachings herein, there is also provided an electron gun, comprising a vacuum tube, and functionally associated with the vacuum tube, a ferroelectric emitter according to the teachings herein.

In some embodiments, the electron gun is configured for sequential activation of the distal emitting electrodes, as described above. In some embodiments, the sequential activation enables the generation of a series of substantially consecutive short electron beam pulses, each pulse generated by activation of a distal emitting electrode. In some embodiments, the series of substantially consecutive short electron beam pulses constitutes a relatively long current pulse (i.e., a beam of electrons). In some embodiments, the series of substantially consecutive short electron beam pulses constitutes a continuous beam of electrons.

In some embodiments, the electron gun is configured to have a maximal duty cycle of not less than 10%, not less than 14%, not less than 20%, not less than 30%, not less than 40%, not less than 50%, not less than 54%, not less than 60%, not less than 70%, not less than 80%, not less than 90% and even not less than not less than 100%.

In some embodiments, the electron gun is configured to have a variable, user-selectable duty cycle. In some embodiments, such a user-selectable duty cycle is variable between any two values from 0% to 100%. In some embodiments, such a user-selectable duty cycle is variable by changing a duty cycle of at least one emitting electrode, a pulse-repetition frequency of at least one emitting electrode, a pulse width of at least one emitting electrode and an inter-pulse interval of at least one emitting electrode.

In some embodiments, the electron gun further comprises an anode, configured to generate an electric field that accelerates electrons released by the ferroelectric emitter towards a distal end of the vacuum tube. An electric field of any suitable potential is used to accelerate the electrons. In some embodiments, the potential difference of the electric field is not less than 100 V. In some embodiments, the potential difference of the electric field is not more than 500 kV, and in some embodiments not more than 50 kV.

In some embodiments, the electron gun further comprises an electron extractor located distally to the ferroelectric emitter, configured to separate electrons from a plasma generated during activation of the distal emitting electrodes. In some embodiments, the electron extractor extracts electrons by generating an electric field that extracts electrons released by the ferroelectric emitter. An electric field of any suitable potential is used to extract the electrons. In some embodiments, the potential difference of the electric field is not less than 100 V. In some embodiments, the potential difference of the electric field is not more than 5000 V. In some such embodiments, the electron gun further comprises an anode (as described in the paragraph immediately hereinabove), configured to apply an electrostatic force to electrons released by the ferroelectric emitter, to accelerate the electrons towards a distal end of the vacuum tube as described above; wherein the electron extractor is located between the ferroelectric emitter and the anode.

Radiation-Generating Device

According to an aspect of some embodiments of the teachings herein, there is also provided a radiation-generating device, comprising a ferroelectric emitter according to the teachings herein.

According to an aspect of some embodiments of the teachings herein, there is also provided a radiation-generating device, comprising an electron gun according to the teachings herein.

In some embodiments, the radiation-generating device further comprises: a gyrotron tube functionally associated with the electron gun so that electrons generated by the electron gun enter a cavity of the gyrotron tube, thereby driving the gyrotron tube to emit radiation.

In some embodiments, the teachings herein provide a method for operating an electron tube for radiation generation at any suitable desired frequency.

In some embodiments, the teachings herein provide a method for operating a gyrotron tube. In some embodiments, the method allows operating a gyrotron tube at a desired frequency, that is to say, to generate any suitable frequency of radiation.

In some embodiments, the method produces a long current pulse (of electrons) and/or a long radiation pulse having a desired frequency using a ferroelectric emitter. The long current pulse is substantially longer than a constituent short pulse generated by a single distal electrode.

In some embodiments, the method produces a continuous current (of electrons) and/or continuous radiation having a desired frequency using a ferroelectric emitter.

Referring now to the drawings, FIG. 1 is a schematic depiction of front, side, and rear views of an embodiment of a ferroelectric emitter 100 according to the teachings herein.

Emitter 100 includes an emitter body 102 made of ferroelectric material, having a distal face 102*a* and a proximal face 102*b*. At least a portion of proximal face 102*b* of emitter body 102 is in contact with a metal component that constitutes a non-emitting proximal electrode 104. At least a portion of distal face 102*a* of emitter body is in contact with at least two (in emitter 100, two) mutually-separated metal plates each constituting an independently-operable distal emitting electrode 106 and 108.

Although in the specific embodiment depicted in FIG. 1 electrodes 106 and 108 are rectangular plates, as noted above, in some embodiments electrodes having other shapes are used.

In some embodiments, an emitter according to the teachings herein includes more than two distal emitting electrodes, e.g., at least three, at least four, at least five, at least six or at least 20 distal emitting electrodes. In some embodiments, there are even at least 10000 distal emitting electrodes, for example, arranged in a 100×100 electrode matrix. In a non-limiting embodiment, emitter body 102 is a 2.5 mm thick, 18 mm diameter barium titanate ($BaTiO_3$) ceramic disk. Proximal electrode 104 is a 17.5 mm diameter 0.5 mm thick round conductive material, for example a metal such as copper. Distal electrodes 106 and 108 are both 0.5 mm thick metal rectangular panels 6.60×1.7 mm mutually separated by a gap of 2.5 mm. Such an embodiment was made and used by the Inventor to perform experiments, the results of which are illustrated in FIGS. 5*a*-5*f* and in FIGS. 6*a*-6*d*.

A proximal electrode (such as 104) is not exposed to plasma, and so is fashioned from any suitable conductive material.

A distal electrode (such as 106 or 108) is exposed to plasma, and so is preferably fashioned from a conductive metal. Although generally a distal electrode is fashioned of any metal (e.g., copper), in some embodiments it is preferred that a distal electrode is fashioned from a more resistant metal to provide a distal electrode having greater resistance to erosion, and therefore a longer expected lifetime. Suitable metals include copper, brass, stainless steel, tantalum and aluminum.

Figure 2:
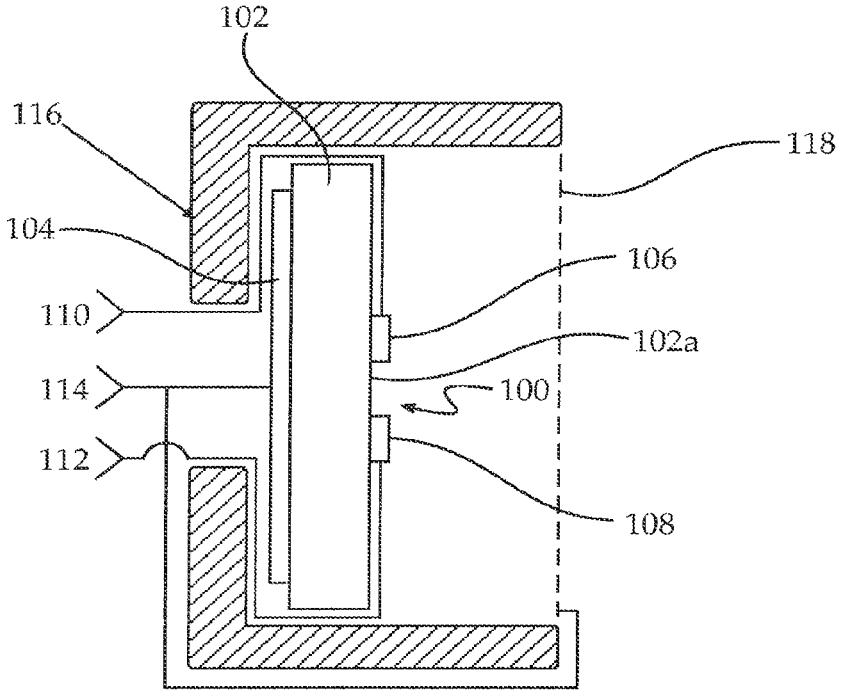
FIG. 2 is a schematic depiction of a side cross-section of the ferroelectric emitter of FIG. 1 having two distal emitting (front) electrodes, each controlled by a respective trigger, according to some embodiments of the teachings herein.

Reference is now made to FIG. 2, which is a schematic depiction of a side cross-section of an embodiment of a ferroelectric emitter 100 having two distal electrodes 106 and 108, each activatable by an independently-operable functionally-associated trigger 110 and 112, respectively.

To fit emitter 100 in an electron gun, emitter 100 is placed in an electrically-insulating holder 116 (a polyethylene "cup") having an open end, which open end is covered with a conductive grid 118. Grid 118 in the Figure is a 70% open metal (stainless steel) mesh. In implementing the teachings herein, any suitable mesh may be used, in some embodiments being more than 70% open and in some embodiments being less than 70% open. A suitable mesh is preferably resistant to erosion and other damage from plasma, for example is of stainless steel. In some embodiments, the distance between any two strands of the mesh is less than 500 micrometers. In a non-limiting example, grid 118 is placed 6 mm from distal face 102*a* of emitter 100.

Electrical leads are connected to the various components, including through holder 116 as required. Distal electrode 106 is activatable by a respective trigger 110 and distal electrode 108 is activatable by a respective trigger 112. Triggers 110 and 112 are independently operable, enabling independent activation of distal electrodes 106 and 108, respectively. Proximal electrode 104 is functionally associated with a power source 114.

Figure 3:
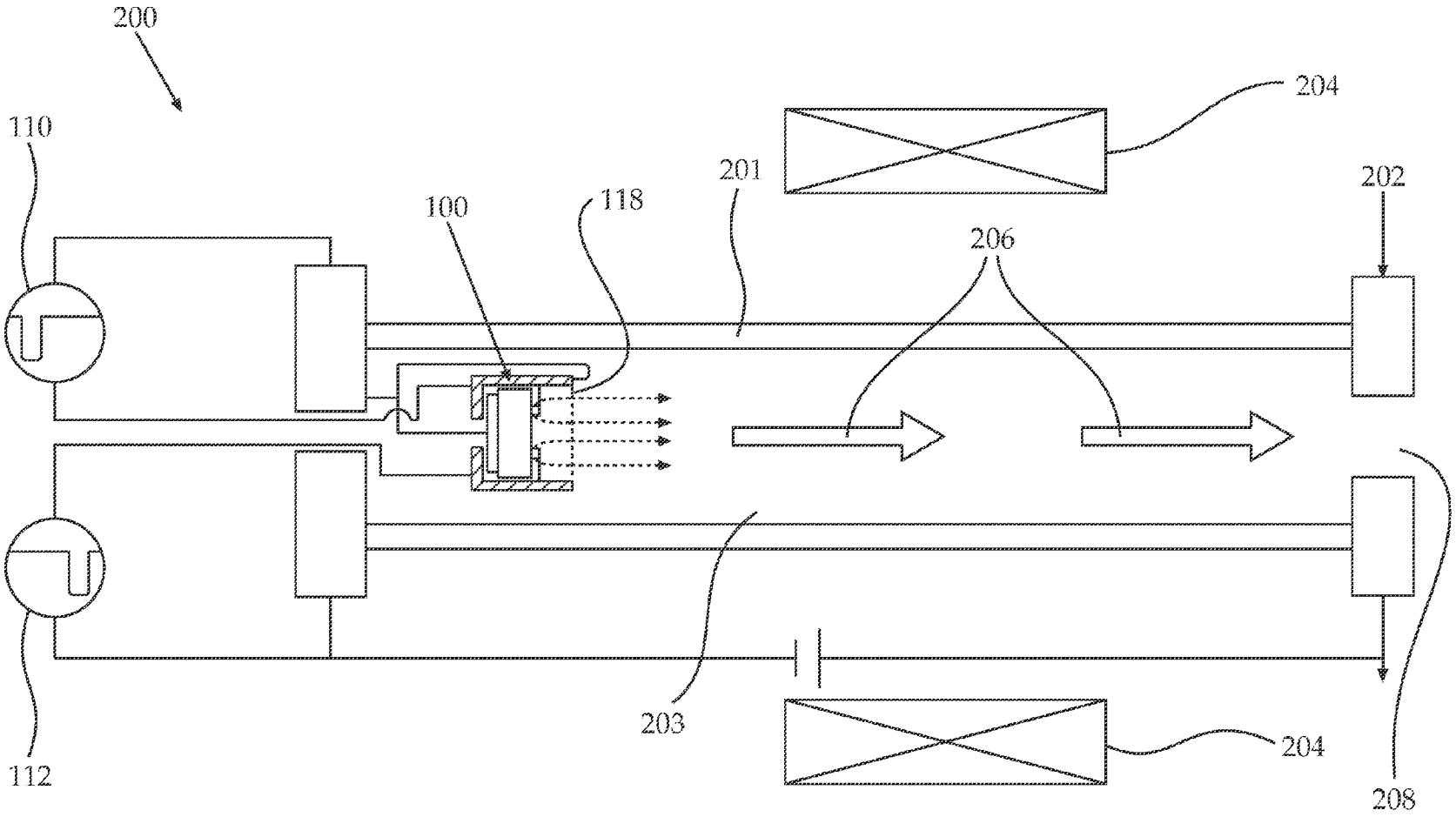
FIG. 3 is a schematic drawing illustrating an electron gun having a ferroelectric emitter according to an embodiment of the teachings herein.

The holder-emitter assembly depicted in FIG. 2 may be used, in the usual way, as a component of an electron gun as depicted in FIG. 3, which is a schematic drawing of an embodiment of an electron gun 200 including a casing 201 made of an insulator defining an electron gun chamber 203, comprising a ferroelectric emitter 100 according to the teachings herein.

During typical operation of an electron gun such as 200:

an anode 202 is grounded;

a suitable DC potential is applied to proximal electrode 104 and to grid 118 (any suitable potential is used, as known in the art of FE emitters, typically in the order of about −2 kV to about −50 kV, more typically about −9 kV to about −13 kV, in the experiments herein the DC potential was −11.9 kV);

using triggers 110 and 112 (produced by fast high voltage switches such as HTS-150 GPSM by Behlke), −1.5 kV 300 ns wide potential pulses are sequentially applied to distal emitting electrodes 106 and 108, thereby sequentially activating these distal emitting electrodes; (depending on the embodiment, the width of the potential pulses is any suitable width, typically between 50 ns and 1000 ns; depending on the embodiments the potential of the pulse is typically between −1 kV and −5 kV) and a ~50 G constant axial magnetic field is induced by an external gun solenoid 204 surrounding electron gun 200.

As known to a person having ordinary skill in the art, during operation of a ferroelectric emitter (such as 100), for example, in an electron gun 200, emitting electrodes 106 and 108 are located in a vacuum. In electron gun 200, electron gun chamber 203 is evacuated suitably low pressure (typically not more than $10^{-4}$ Torr ($10^{-1}$ Pascal) to serve as a vacuum tube or vacuum chamber.

As is seen in FIGS. 5 and 6 below, the potential pulses applied by triggers 110 and 112 cause electrons to be released from distal emitting electrodes 106 and 108. The electrons are accelerated distally towards and past grid 118 by the electric field formed by the potential difference in chamber 203. The magnetic field induced by solenoid 204 limits the radial expansion of the generated electrons and guides the resulting electron beam 206 through a gap 208 in the center of anode 202.

It is important to note that some electron emitters, such as ferroelectric emitters, generate a plasma of heavy positively-charged ions and electrons. It is known in the art that it is difficult to accelerate electrons generated in such emitters sufficiently to be able to use the electrons for generating radiation, for example using a gyrotron. Although not wishing to be held to any one theory, it is hypothesized that electrostatic interaction of the electrons with positively-charged ions in the plasma prevents sufficient acceleration. It has been found by the Inventor that when implementing a plasma-generating electron emitter such as described in some embodiments herein, it is advantageous to include an electron extractor, a component that allows separation of the electrons from the plasma. In electron gun 200, grid 118 serves as an electron extractor.

In the art, it is known to use an electron gun that generates an electron beam to drive a gyrotron tube to generate radiation. In some embodiments of the teaching herein, an electron gun according to the teachings herein is used to drive a gyrotron tube to generate radiation.

Figure 4:
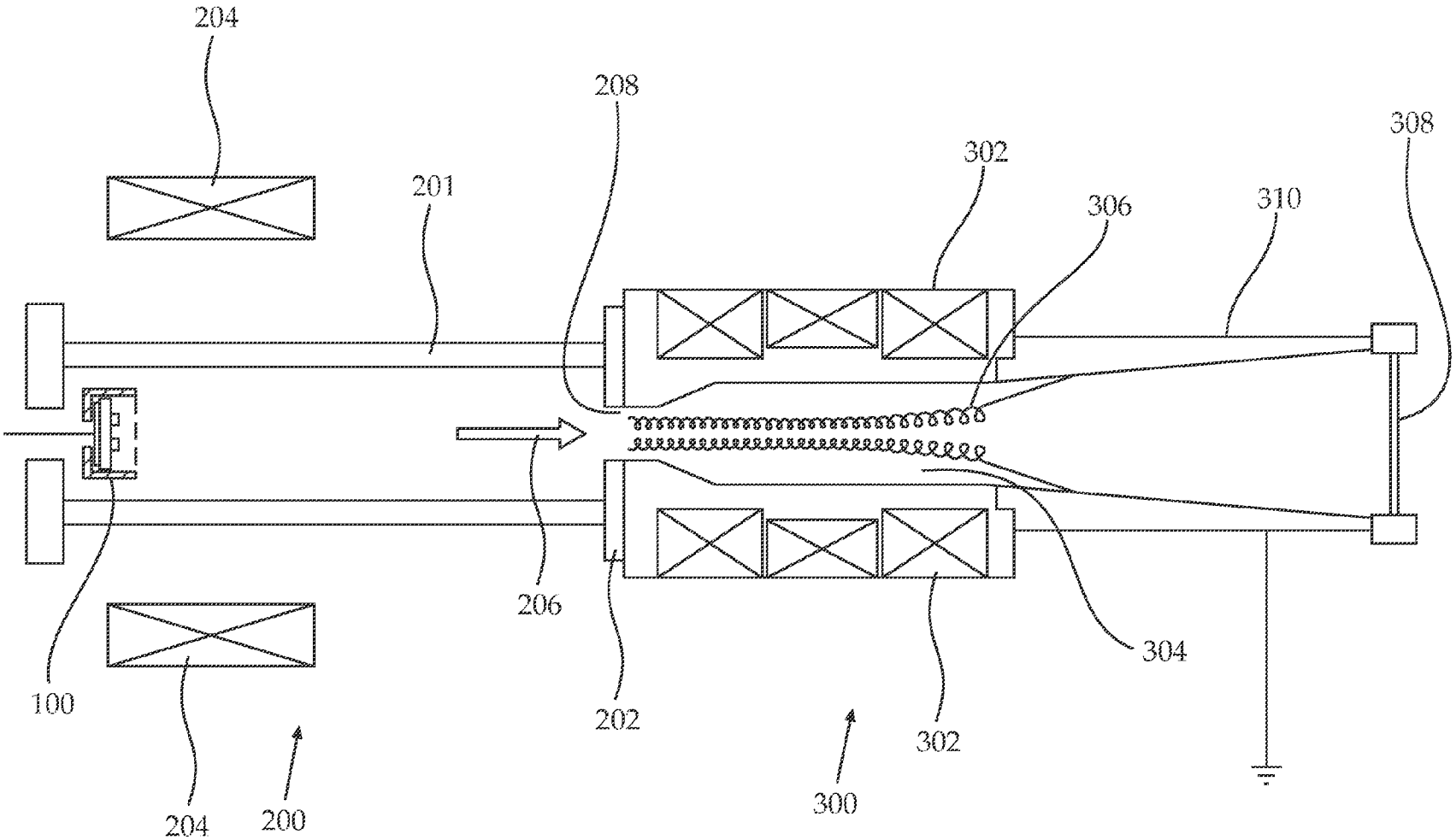
FIG. 4 is a schematic depiction of an embodiment of a gyrotron tube driven by the electron gun of FIG. 3.

Reference is now made to FIG. 4, a schematic depiction of a gyrotron tube 300 driven by an electron gun 200 of FIG. 3, and including a tube solenoid 302 to generate an axial magnetic field. As known in the art for FE emitters, during operation of a gyrotron tube, the pressure inside the tube is maintained at ~$10^{-6}$ Torr (~$10^{-4}$ Pa).

The operation of electron gun 200 and tube solenoid 302 is synchronized so that a produced electron beam 206 propagates through the magnetic field generated by tube solenoid 302.

During use of gyrotron tube 300, electron beam 206 generated by electron gun 200 as described above exits through gap 208 in anode 202 of electron gun 200 and enters a cavity 304 of gyrotron tube 300, where the interaction between electron beam 206 and the gyrotron magnetic field generated by tube solenoid 302 occurs in the usual way as known in the field of gyrotrons. During the interaction with the magnetic field generated by tube solenoid 302, the electrons of electron beam 206 are forced to adopt cyclotron motion 306 in the strong magnetic field, thereby generating electromagnetic radiation of a desired frequency. The generated electromagnetic radiation is emitted through an output window 308 (in the gyrotron tube experimentally used by the Inventors, output window 308 was of polytetrafluorethylene, e.g., Teflon® by DuPont) while the electrons impact electron collector 310 that is configured to dissipate heat and charge generated during gyrotron operation.

The gyrotron tube experimentally used by the Inventors was a 25 GHz $TE_{11}$ first harmonic gyrotron. The magnetic field generated in the interaction region of gyrotron cavity 304 by tube solenoid 302 was ~10.6 kG.

Experimental

Testing an Electron Gun According to the Teachings Herein

A first set of experiments was performed to study operation of an embodiment of an electron gun 200 according to the teachings herein, specifically to measure the current produced at anode 202 (using a Rogowski coil) when electron gun 200 was activated, to determine whether interference is present between the plasma generated by a first triggered distal electrode 106 and a subsequently-triggered distal electrode 108.

The results of these experiments are discussed with reference to FIG. 5, the plots illustrating experimental results indicative of charge production by a ferroelectric emitter 100 as described above, for different delay times between triggering of the two distal electrodes, 106 and 108.

Figure 5A:
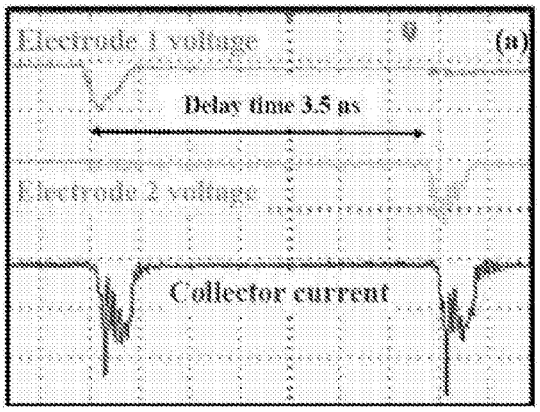
FIGS. 5*a*-5*f* are plots illustrating experimental results indicative of charge production by a ferroelectric emitter as described above, for different delay times between the triggers of the distal emitting (front) electrodes.
Figure 5D:
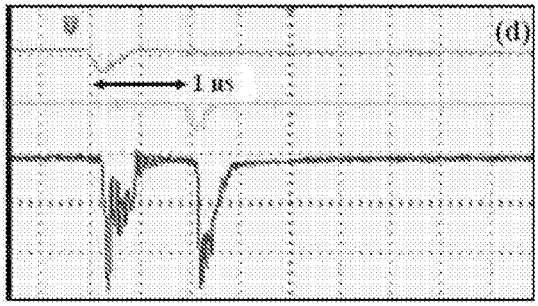
Figure 5B:
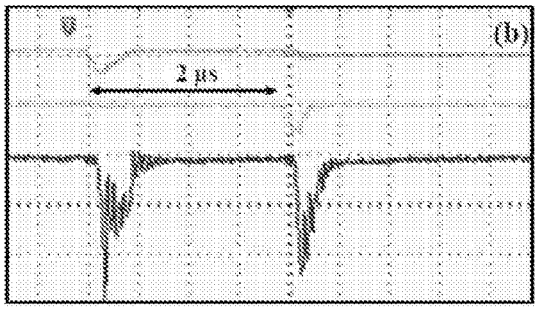
Figure 5E:
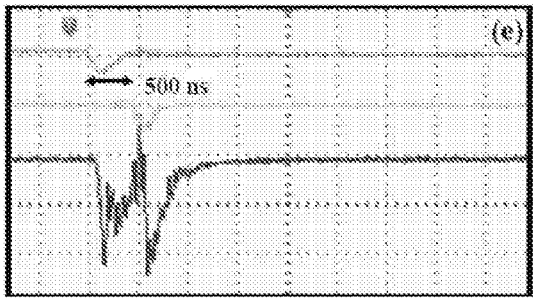
Figure 5C:
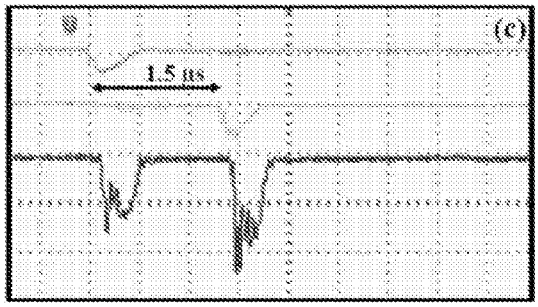
Figure 5F:
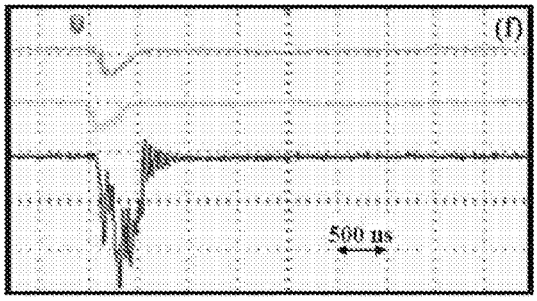

Each one of distal electrodes 106 and 108 was activated by a respective trigger 110 and 112. In this manner the duty cycles of each distal electrode 106 and 108 could be changed separately and the operations of distal electrodes 106 and 108 could be synchronized. As noted above, each distal electrode was triggered by a single 500 ns wide voltage pulse. FIGS. 5*a*-5*f* show two trigger signals (represented by the two upper plots in each figure) actuating the respective distal electrodes at different time intervals, and two current measurements (represented by the lowermost plot in each figure) resulting from the actuation of the electrodes. The time differences tested were 3.5 microseconds (FIG. 5*a*); 2.0 microseconds (FIG. 5*b*); 1.5 microseconds (FIG. 5*c*); 1.0 microseconds (FIG. 5*d*); 0.5 microseconds (FIG. 5*e*); and 0 microseconds (FIG. 5*f*).

A current of ~1 A with ~500 nanosecond duration was measured in response to each pulse. It is seen that the inter-trigger delay between the pulses can be gradually reduced until the pulses are simultaneous (FIG. 5*f*). A comparison of the total electric charge of each individual pulse in FIGS. 5*a*-5*e* ($3.81\times10^{-7}$ q, $3.41\times10^{-7}$ q) with pulse electric charge of the combined pulse in FIG. 5*f* ($7.22\times10^{-7}$ q) shows that the amount of electric charge did not change: the charge of the combined pulse was substantially the sum of charges of the two constituent pulses. These results clearly indicate that the two distal emitting electrodes can be activated simultaneously without substantial mutual interference.

Testing a Gyrotron Tube According to the Teachings Herein

A second set of experiments was performed to study operation of an embodiment of a gyrotron tube such as 300 driven by an electron gun such as electron gun 200 according to the teachings herein, specifically to measure the current and radiation produced at collector 310 and output window 308 of gyrotron tube 300 when electron gun 200 was activated.

The current was measured using a Rogowski coil. The radiation resulting from the interaction in the gyrotron tube was measured by a horn antenna, a detector and an attenuator connected to an oscilloscope at a distance of 1.8 m from output window 308 of gyrotron tube 300.

The results of these experiments are discussed with reference to FIGS. 6*a*-6*d*, which are plots illustrating experimental results showing the generation of current and radiation by a gyrotron tube such as 300, in which each distal electrode 106 and 108 was independently triggered with a series of 300 ns pulses with complementary timing.

The duty cycle of each pulse series was gradually changed from ~7%~8% (~300 ns width every 4 microseconds) to ~50% (300 ns width every 600 ns) and the PRF was varied from 0.25 MHz to 1.6 MHz, by gradually reducing the time delay between triggering of the two distal electrodes.

Figure 6A:
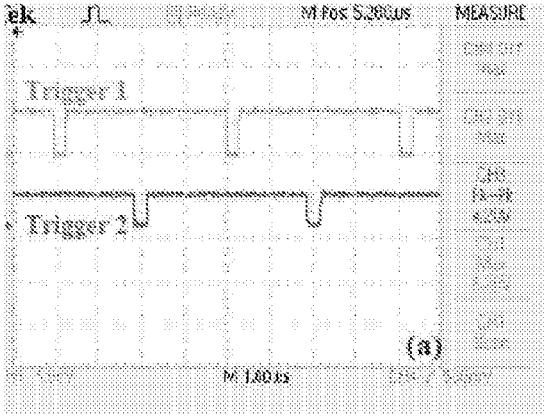
FIGS. 6*a*-6*d* are plots illustrating experimental results showing the production of current and radiation by a gyrotron as described in FIG. 4, in which the emitter's distal emitting (front) electrodes are driven by respective series of pulses.

For example, as seen in FIG. 6*a*, in one experiment each distal electrode was triggered with a 300 ns pulse repeated every 4 microseconds (0.25 MHz), with a 2 microsecond delay between any two consecutive triggerings of the two distal electrodes. Accordingly, each electrode had a duty cycle of 7.5%, and the emitter, electron gun and gyrotron all have a duty cycle of 15%.

Figure 6B:
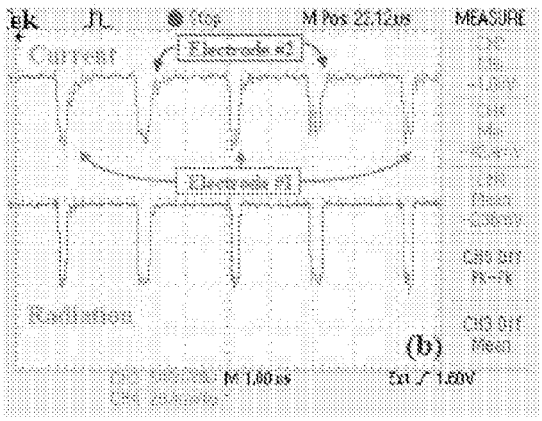

In FIG. 6*b* are depicted the measured current (top plot) and radiation (bottom plot) generated by such triggering, where the duty cycle (~15%) and PRF (0.5 MHz) of the gyrotron is double that of the individual distal electrodes. Accordingly, each electrode had a duty cycle of 15%, and the emitter, electron gun and gyrotron all have a duty cycle of 30%.

Figure 6C:
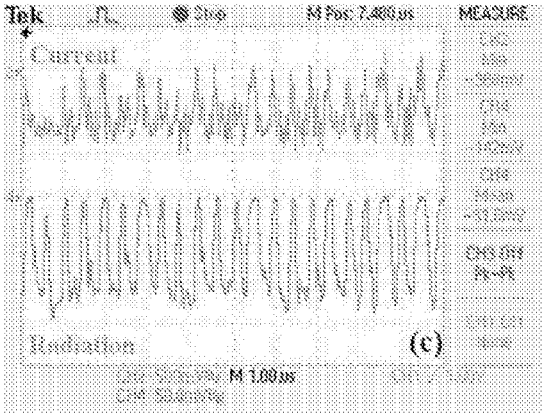

In FIG. 6*c* are depicted the measured current (top plot) and radiation (bottom plot) generated, where each distal electrode is triggered with a 300 ns pulse repeated every 1.1 microseconds at a rate of 0.9 MHz, so that the PRF of the gyrotron was 1.8 MHz at the collector and the individual radiation pulses, although distinct, begin to partially overlap. Accordingly, each electrode had a duty cycle of 27%, and the emitter, electron gun and gyrotron all have a duty cycle of 54%.

Figure 6D:
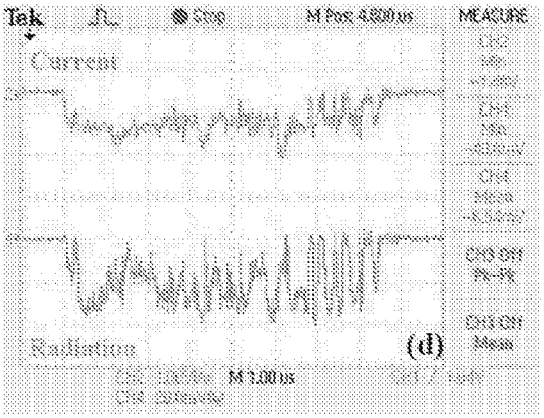

In FIG. 6*d*, as the PRF of each of the distal electrodes was further increased to ~1.6 MHz with ~50% duty cycle yielding a gyrotron PRF of 3.2 MHz at the collector, the collector current and the radiation pulses overlapped each other, effectively forming a single continuous ~7.5 microsecond pulse of both current and radiation. Even in this tight timing regime each distal electrode operates without interference from the other electrode. During the relaxation time of a first distal electrode, a second distal electrode is excited and emits an electron beam. Accordingly, each electrode had a duty cycle of 50%, and the emitter, electron gun and gyrotron all have a duty cycle of 100%.

A frequency of 25 GHz and a power of ~150 W were measured in the diagnostic setup, the conversion efficiency was ~1.8%, relatively low due to cavity ability, a result of the fact that no substantial effort was made to optimize gyrotron cavity 304 to the conditions used.

The specific high voltage switches used as distal electrode triggers were limited to a maximum of ~11-12 pulses in this experimental timing regime by the manufacturer, so that the duration of the combined long pulse (e.g., as depicted in FIG. 6*d*) was limited to ~7.5 μs. As clear to a person having ordinary skill in the art, such a limitation on the duration is an artifact of the switches used and not an inherent emitter limitation.

It has therefore been experimentally demonstrated herein that some embodiments of a plasma-driven electron emitter according to the teachings herein may be used to overcome the prior art plasma relaxation time pulse-length limiting factor, to operate at high PRF and even to generate a sustained, effectively continuous, pulse of electrons, and when used with gyrotron (or the like) electromagnetic radiation of a desired frequency.

It is important to note that an additional pulse-length limiting factor of plasma-driven electron emitters known in the art is gap closure. Such an event occurs when a generated plasma pulse is sufficiently long (in time) so that there is a physical continuity of plasma extending from the cathode to the anode, leading to a short circuit. The teachings herein overcome such gap closure. Without wishing to be held to any one theory, it is currently believed that the plasma generated between any two distal emitting electrodes (such as 106 and 108) and the anode (such as 202) are sufficiently physically separated so that these do not combine to cause gap closure. Apparently as long as each individual emitting distal electrode (such as 106 or 108) of the ferroelectric emitter is operated for a sufficiently short time to avoid gap closure between that individual distal electrode and the anode, no gap closure occurs in the electron gun as a result of operating the ferroelectric emitter.

It has therefore also been shown that two distal electrode in close proximity to each other, (e.g., separated by not more than 2.5 mm), can be operated without mutual interference. By separately triggering each distal electrode with a functionally-associated switch, a high PRF is achieved with flexibility in the possible duty cycle of electron beam generation by the emitter from 0% to 100%. When operating each individual distal electrode at a 50% duty cycle in complementary timing, a combined long electron beam pulse is obtained from the emitter. The combined pulse is substantially longer than a pulse from a single distal emitting electrode.

Herein, a pulse length of 7.5 μs was demonstrated using high-voltage switches limited to executing only 11 pulses. Much longer electron beam pulses can be obtained using an emitter according to the teachings herein with the use of better switches. Additionally, an emitter including more than two distal electrodes in a manner analogous to the described herein will increase the total pulse length and the emitter lifetime.

To verify the suitability of an electron gun comprising an emitter according to the teachings herein as a source for microwave and millimeter wave radiation, such an emitter was integrated into a gyrotron to generate a ~7.5 microsecond radiation pulse. The radiation was obtained substantially continuously during the entire 7.5 microseconds of the current pulse. The difficulties known in the art for generating long pulse radiation from a plasma-assisted electron gun (as described in ref. 13) are overcome using embodiments of the teachings herein.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the appended claims.

Citation or identification of any reference in this application shall not be construed as an admission that such reference is available as prior art to the invention.

Section headings are used herein to ease understanding of the specification and should not be construed as necessarily limiting.

REFERENCES

The following references are considered to pertinent for the purpose of understanding the background of the invention:

[1] G. Rosenman, D. Shur, Y. Krasik and A. Dunaevsky, "Electron emission from ferroelectrics," Journal of Applied Physics, vol. 88, no. 11, pp. 6109, 6161, December 2000.

[2] M. Einat, E. Jerby and G. Rosenman, "Spectral measurements of gyrotron oscillator with ferroelectric electron gun," Applied Physics Letters, vol. 81, no. 7, pp. 1347-9, August 2002.

[3] M. Einat, E. Jerby and G. Rosenman, "High-repetition-rate ferroelectric-cathode gyrotron," Applied Physics Letters, vol. 79, no. 25, pp. 4097-9, December 2001.

[4] M. Einat, E. Jerby and G. Rosenman, "A ferroelectric electron gun in a free-electron maser experiment," Nuclear Instruments & Methods in Physics Research, Section A (Accelerators, Spectrometers, Detectors and Associated Equipment), vol. 483, no. 1-2, pp. 326-30, May 2002.

[5] Y. Hayashi, X. Song, J. D. Ivers, D. Flechtner, J. A. Nation and L. Schacter, "High-power microwave generation using a ferroelectric cathode electron gun," Plasma Science, IEEE Transactions on, vol. 29, no. 4, pp. 599, 603, August 2001.

[6] M. Einat, E. Jerby and G. Rosenman, "Free-electron maser driven by a two-stage ferroelectric electron gun," Journal of Applied Physics, vol. 93, no. 4, pp. 2304, 2306, February 2003.

[7] M. Einat, E. Jerby and G. Rosenman, "A microwave gyro amplifier with a ferroelectric cathode," Microwave Theory and Techniques, IEEE Transactions on, vol. 50, no. 4, pp. 1227, 1230, April 2002.

[8] Y. Hadas, A. Sayapin, T. Kweller and Y. Krasik, "S-band relativistic magnetron operation with an active plasma cathode," Journal of Applied Physics, vol. 105, no. 8, pp. 083307, 083307, April 2009.

[9] M. Einat, M. Pilossof, R. Ben-Moshe, H. Hirshbein and D. Borodin, "95 GHz Gyrotron with Ferroelectric Cathode," Physical Review Letters, vol. 109, no. 18, p. 185101 (5 pp.), November 2012.

[10] V. Engelko, "Formation of stable longpulse electron beams with the help of explosive emission cathodes," Plasma Devices and Operations, vol. 13, no. 2, pp. 135-142, June 2005.

[11] M. Einat, D. Shur, E. Jerby and G. Rosenman, "Lifetime of ferroelectric Pb(Zr,Ti)O3 ceramic cathodes with high current density," Journal of Applied Physics, vol. 89, no. 1, pp. 548, 552, January 2001.

[12] A. Dunaevsky, Y. Krasik, J. Felsteiner, S. Dorfman, A. Berner and A. Sternlieb, "Lifetime of ferroelectric cathodes," Journal of Applied Physics, vol. 89, no. 8, pp. 4480, 4485, April 2001.

[13] M. E. M. Pilossof, "Lifetime extension of ferroelectric cathodes for microwave tubes," Nuclear Instruments & Methods in Physics Research, Section A, vol. 636, no. 1, pp. 8-12, April 2011.

[14] R. Advani, J.-P. Hogge, K. Kreischer, W. Mulligan, R. Temkin, G. Kirkman, B. Jiang and N. Reinhardt, "Kiloampere and microsecond electron beams from ferroelectric cathodes," Plasma Science, IEEE Transactions on, vol. 26, no. 4, pp. 1347, 1352, August 1998.

[15] J. Z. Gleizer, D. Yarmolich, V. Vekselman, J. Felsteiner and Y. E. Krasik, "High-current large-area uniform electron beam generation by a grid-controlled hollow anode with multiple-ferroelectric-plasma-source ignition," Plasma Devices and Operations, vol. 14, no. 3, pp. 223-235, August 2006.

The invention claimed is:

1. A ferroelectric emitter, comprising:

an emitter body having a distal face and a proximal face;

a proximal electrode in contact with at least a portion of the proximal face;

at least one first distal electrode, located at the distal face of the emitter body;

at least one first trigger;

wherein the first trigger is configured to activate the first distal electrode by applying potential pulses to the first distal electrode to cause a first plurality of electrons to be released from the first distal electrode to produce at least one first beam pulse;

at least one second distal electrode, located at the distal face of the emitter body;

at least one second trigger;

wherein the second trigger is configured to activate the second distal electrode independently from the activation of the first distal electrode by applying potential pulses to the second distal electrode to cause a second plurality of electrons to be released from the second distal electrode to produce at least one second beam pulse;

wherein the ferroelectric emitter is configured to produce an electron beam, consisting of the first beam pulse and the second beam pulse.

2. The ferroelectric emitter of claim 1, wherein the first distal electrode and the second distal electrode are coplanar.

3. The ferroelectric emitter of claim 1, wherein the ferroelectric emitter achieves a pulse repetition frequency of up to 3 MHZ, a duty cycle of the electron beam is from 0% to 100%, and a pulse length of the electron beam is up to 7.5 microseconds.

4. The ferroelectric emitter of claim 1, wherein the emitter body is made of a ferroelectric material.

5. The ferroelectric emitter of claim 1, wherein the at least two distal electrodes are exposed to plasma and are made of a conductive material.

6. The ferroelectric emitter of claim 1, wherein the proximal electrode is not exposed to plasma and is made of a conductive material.

7. The ferroelectric emitter of claim 1, wherein the proximal electrode is associated with a power source.

8. The ferroelectric emitter of claim 1, wherein the potential pulses have a width between 50 ns and 1000 ns.

9. A holder-emitter assembly, comprising:

an electrically-insulating holder having an open end; and the ferroelectric emitter of claim 1 placed in the electrically-insulating holder, wherein the open end of the electrically-insulating holder is covered with a conductive grid placed at a distance from the distal face of the ferroelectric emitter.

10. An electron gun, comprising:

a casing defining a chamber;

the holder-emitter assembly of claim 9 placed on a first end of the chamber;

an anode having a gap in the center placed on a second end of the chamber; and an external gun solenoid inducing a constant axial magnetic field surrounding the electron gun.

11. The electron gun of claim 10, wherein the anode is grounded.

12. The electron gun of claim 10, wherein the casing is made of an insulator.

13. The electron gun of claim 10, wherein a DC potential is applied to the proximal electrode and to the grid.

14. The electron gun of claim 10, wherein the electron beam accelerated towards and past the grid by an electric field formed by a potential difference in the chamber.

15. The electron gun of claim 10, wherein the magnetic field induced by the external gun solenoid limits a radial expansion of the electrons released from the at least two distal electrodes and guides the electron beam through the gap of the anode.

16. A gyrotron tube driven by the electron gun of claim 10, comprising:

a tube solenoid configured to generate an magnetic field;

a cavity having a first end connecting the anode of the electron gun and a second end having an output window, wherein the electron beam generated by the electron gun exits through the gap of the anode and enters the cavity from the first end of the cavity, and an electromagnetic radiation is emitted through the output window at the second end of the cavity; and an electrons impact electron collector on a side of the cavity.

17. The gyrotron tube of claim 16, wherein the operation of the electron gun and the tube solenoid is synchronized so that the electron beam propagates through the magnetic field generated by tube solenoid.

18. The gyrotron tube of claim 16, wherein during an interaction of the electrons of the electron beam with the magnetic field generated by tube solenoid, the electrons are forced to adopt cyclotron motion in the magnetic field, thereby generating the electromagnetic radiation.

19. The gyrotron tube of claim 16, wherein the electrons impact electron collector is configured to dissipate heat and charge generated during the operation of the gyrotron.

20. A method for generating an electron beam, comprising:

a) providing a ferroelectric emitter, wherein the ferroelectric emitter comprises:

an emitter body having a distal face and a proximal face;

a proximal electrode in contact with at least a portion of the proximal face;

at least one first distal electrode, located at the distal face of the emitter body;

at least one first trigger;

wherein the first trigger is configured to activate the first distal electrode by applying potential pulses to the first distal electrode to cause a first plurality of electrons to be released from the first distal electrode to produce at least one first beam pulse;

at least one second distal electrode, located at the distal face of the emitter body;

at least one second trigger;

wherein the second trigger is configured to activate the second distal electrode independently from the activation of the first distal electrode by applying potential pulses to the second distal electrode to cause a second plurality of electrons to be released from the second distal electrode to produce at least one second beam pulse;

wherein the ferroelectric emitter is configured to produce an electron beam, consisting of the first beam pulse and the second beam pulse; and independently activating the first trigger to produce the first beam pulse; and independently activating the second trigger to produce the second beam pulse.

21. The method of claim 20, further comprising:

during said independently activating the first distal electrode and the second distal electrode, varying a duty cycle of said ferroelectric emitter.

22. The method of claim 21, wherein said varying the duty cycle of said ferroelectric emitter comprises changing at least one variable selected from the group of variables consisting of:

a pulse width of at least one of the first distal electrode and the second distal electrode;

an inter-pulse interval of at least one of the first distal electrode and the second distal electrode;

a pulse-repetition frequency of at least one of the first distal electrode and the second distal electrode; and a duty cycle of at least one of the first distal electrode and the second distal electrode.

23. The method of claim 20, wherein said independently activation of the first distal electrode and the second distal electrode comprises:

from the first distal electrode, generating the first beam pulse for a first period of time having a first starting time, a first duration, and a first ending time; and subsequent to said first starting time, from the second distal electrode, generating the second beam pulse for a second period of time having a second starting time, a second duration, and a second ending time, wherein said second ending time is subsequent to said first ending time.

24. The method of claim 20, wherein said independently activation of the first distal electrode and the second distal electrode comprises:

from the first distal electrode, generating the first beam pulse for a first period of time having a first starting time, a first duration, and a first ending time; and subsequent to said first ending time, from the second distal electrode, generating the second beam pulse for a second period of time having a second starting time, a second duration, and a second ending time.

25. A method of generating radiation comprising:

generating an electron beam pulse according to the method of claim 20; and directing said generated electron beam pulse to enter a magnetic field, thereby generating radiation.

26. A method of generating radiation comprising:

generating an electron beam pulse according to the method of claim 20; and directing said generated electron beam pulse to drive a radiation-generating device the radiation-generating device thereby generating radiation.

27. The method of claim 26, wherein said radiation-generating device is a gyrotron tube.

28. The method of claim 26, wherein the frequency of the generated radiation is between 1 and 300 GHz.

29. The method of claim 20, wherein the ferroelectric emitter achieves a pulse repetition frequency of up to 3 MHZ, a duty cycle of the electron beam is from 0% to 100%; and a pulse length of the electron beam is up to 7.5 microseconds.

* * * * *